US008189829B2

(12) United States Patent
Vonlanthen

(10) Patent No.: US 8,189,829 B2
(45) Date of Patent: May 29, 2012

(54) RESISTANCE-BASED IDENTIFICATION

(75) Inventor: Andi Vonlanthen, Remetschwil (CH)

(73) Assignee: Phonak AG, Staefa (CH)

( * ) Notice: Subject to any disclaimer, the term of this patent is extended or adjusted under 35 U.S.C. 154(b) by 1251 days.

(21) Appl. No.: 11/828,368

(22) Filed: Jul. 26, 2007

(65) Prior Publication Data

US 2009/0028364 A1 Jan. 29, 2009

(51) Int. Cl.
*H04R 25/00* (2006.01)

(52) U.S. Cl. ..... 381/312; 381/314; 381/323

(58) Field of Classification Search ..... 381/312, 381/314, 323

See application file for complete search history.

(56) References Cited

U.S. PATENT DOCUMENTS

| | | | | |
|---|---|---|---|---|
| 5,555,725 | A * | 9/1996 | Shimasaki et al. | 60/277 |
| RE36,495 | E | 1/2000 | Blakeley et al. | |
| 7,274,168 | B2 * | 9/2007 | Tskukamoto et al. | 320/106 |
| 7,286,678 | B1 * | 10/2007 | Bachler et al. | 381/314 |
| 7,599,500 | B1 * | 10/2009 | Segel et al. | 381/60 |
| 2006/0004930 | A1 * | 1/2006 | Patino et al. | 710/16 |
| 2006/0227988 | A1 * | 10/2006 | Jorgensen et al. | 381/317 |
| 2009/0103754 | A1 * | 4/2009 | Gottschalk et al. | 381/312 |
| 2010/0111315 | A1 * | 5/2010 | Kroman | 381/60 |

FOREIGN PATENT DOCUMENTS

| | | | |
|---|---|---|---|
| JP | 2004111399 | A | 4/2004 |
| JP | 2005038492 | A | 2/2005 |
| JP | 2005315757 | A | 11/2005 |
| WO | 9909799 | A | 3/1999 |
| WO | 2006071210 | A1 | 7/2006 |
| WO | WO 2009006889 | A1 * | 1/2009 |

OTHER PUBLICATIONS

International Search Report dated May 13, 2008.

* cited by examiner

*Primary Examiner* — Steven Loke
*Assistant Examiner* — Cuong Nguyen
(74) *Attorney, Agent, or Firm* — Pearne & Gordon LLP

(57) ABSTRACT

For the identification of peripheral devices on a hearing aid, these devices are provided with an identification resistor (R) that can be read out by the configuration of the hearing aid.

9 Claims, 2 Drawing Sheets

RESISTANCE-BASED IDENTIFICATION

BACKGROUND OF THE INVENTION

1. Field of the Invention

This invention relates to a hearing aid, a method for producing a hearing aid, as well as a module that connects to the signal processing unit of a hearing aid.

2. Description of Related Art

WO 99/09799, held by the applicant for this current patent application, states that hearing aids are extremely complex systems; that, to meet the various user requirements, it is necessary to make a large number of different hardware configurations available, resulting in an extremely cost-intensive, wide variety of models in production, sales and hearing aid dispensing, which necessitates the manufacture, labeling and administrative control of a multitude of different device configurations; that the distribution network must maintain a corresponding volume of inventory; and that the fitting of hearing aids requires a diversity of procedures depending on the device configuration involved.

WO 99/09799 solves these problems by introducing a hearing aid of a design as specified in claim 1 of that document. In claim 9 it also specifies a method for its manufacture.

BRIEF SUMMARY OF THE INVENTION

Improving on the aforementioned hearing aid and method, it is the objective of this present invention to introduce a simple, cost-effective form of implementation. This is accomplished in that the identifying unit is configured as an identification resistor and that, by way of a resistance measuring unit, said identifying unit is functionally connected to the input of the comparator.

This takes into consideration the fact that resistors are available, or manufacturable, with a wide range of precisely measurable resistance values, for instance as discrete elements or applied by thin-film or thick-film technology, and that the prevailing resistance value can be easily and quickly determined by what is essentially a current/voltage measurement. It follows that a resistor is superbly suitable for use as an identifying unit.

Where in this description reference is made to an identification resistor, it is to be understood as an impedance element which, measured at its two connecting points, covers a wide frequency range for instance up to 100 kHz with a substantially predominant real component. An identification resistor of this type may consist of a single resistor or of several resistors connected in series and/or in parallel. As mentioned above, the measured impedance includes a substantially preponderant effective or real component, which does not necessarily rule out an imaginary component due for instance to parasitic capacitances or inductances.

Measuring the resistance on the resistance measuring unit allows the recognition of the integrated peripheral device by the value of its identifying resistance. Comparing that resistance value with the possible resistance values stored in the memory that contains the available identification variables, in conjunction with the specific characteristic quantities of the peripherals concerned, such as the operating parameters for the signal processing unit, permits the utilization of the appropriate parameters for the particular hardware configuration concerned.

The additional benefits of this concept are as follows:

Once assembled, the hearing aid will identify itself in terms of its hardware configuration.

By virtue of the fact that the comparator output is interactively connected to the input of a configuration memory module and that the hearing aid is provided with a port that connects interactively to the output of that configuration memory module, it becomes possible to read out the hardware constellation of the hearing aid. In many cases that obviates the need for specific labeling, for instance on the packaging, in turn eliminating potential errors in production control, in sales and in the fitting of the hearing aids. It also rules out the possibility of testing, supplying or fitting a given hearing aid on the basis of some erroneously assumed peripheral-hardware configuration. It thus retains the inherent benefits of the general approach according to WO 99/09799 while additionally taking advantage of a supremely simple, fast and precise identification technique according to this present invention, that being resistance-based identification.

In one form of implementation of the hearing aid according to the invention, the peripheral device is provided with two ports that are interconnected by way of the identification resistor only. In the identifying resistance measurement of the peripheral device concerned, this prevents any intrinsic input impedance from corrupting the identification.

In another design version of the hearing aid according to the invention, the comparator output is functionally connected to an operating control input on the signal processing unit. This permits the automatic invocation in the signal processing unit of the optimal operating parameters assigned to an identified peripheral device. If the system recognizes that an integrated peripheral device is not compatible with the signal processing unit provided, which may be indicated for instance by the absence of the appropriate identification resistance value among the available identification values stored in the identification options memory module, it can lock out the peripheral device concerned and/or the signal processing unit, thus preventing potential damage.

The identification options memory module may also contain for instance operating programs for the signal processing unit, designed for driving the peripheral device concerned, whereby it is possible, through a wireless or hard-wired connection via a transceiver, to block operating routines intended for the signal processing unit if and when they are incompatible with the peripheral device identified in the respective system configuration concerned.

In another embodiment of the hearing aid according to the invention, the output of the comparator is functionally connected, as already mentioned above, to the input of a configuration memory module and in another implementation the hearing aid is provided with a port that connects to the output of the configuration memory module. In any given hearing aid according to the invention, the current system constellation can thus be read out at any time.

In another design version of the hearing aid according to the invention, the peripheral device is a sensor, an actuator, a transceiver, a manual selector switch, a potentiometer, an acousto-electric input converter or an electro-mechanical output converter.

In a particularly preferred embodiment of the hearing aid according to the invention, the peripheral device is a speaker assembly.

The process according to the inventive production method provides for the identity of the peripheral device to be automatically queried by means of a resistance measurement and then stored. In one implementation of that method, the identity of the peripheral device thus ascertained serves to control or select the operation of the signal processing unit while at the same time preferably locking out any operation extrinsic to that of the selected peripheral device.

In another form of implementation of the method according to the invention, the identification made by means of the identification resistor causes signals traveling to and/or from the signal processing unit to be interpreted and processed differently.

Also introduced is a module for incorporation in the signal processing unit of a hearing aid, featuring two ports that are interconnected exclusively by an identification resistor.

In one embodiment, that module is a speaker assembly for a hearing aid.

With regard to the possibilities generally derived from the auto identification of peripheral devices on hearing aids, reference is made to all of the features described in the above-mentioned WO 99/09799 in addition to those described in this present patent application.

BRIEF DESCRIPTION OF THE DRAWINGS

The following will explain this invention in more detail with the aid of examples and the attached drawings in which.

DETAILED DESCRIPTION OF THE INVENTION

Figure 1:
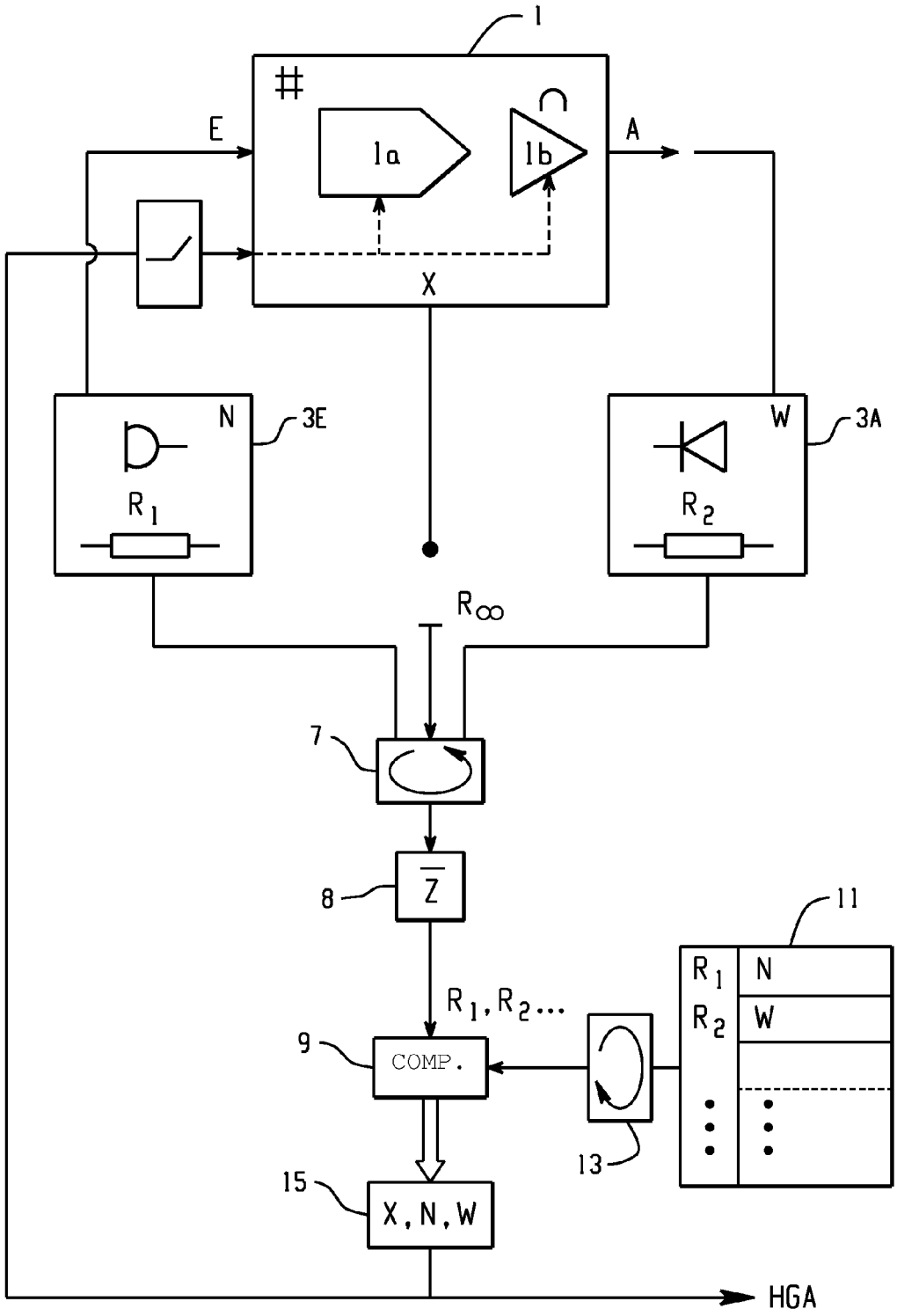
FIG. 1 illustrates the basic operating principle of the hearing aid according to the invention by means of a signal-flow/functional block diagram.

In the form of a signal-flow/functional block diagram, FIG. 1 depicts a hearing aid according to the invention, encompassing, as an example, two peripheral devices $\mathbf{3}_E$ and $\mathbf{3}_A$, configured according to the invention. A signal processing unit 1, performing digital and/or analog signal processing and represented by the DSP/digital signal processing unit 1*a* and the amplifier 1*b*, is provided with input and output connections. The output of the peripheral device $\mathbf{3}_E$ connects to the input E of the signal processing unit 1, one output A of the signal processing unit 1 connects to the input of the peripheral device $\mathbf{3}_A$. The peripheral devices whose inputs and/or outputs functionally connect to the outputs and/or inputs of the signal processing unit 1, may be sensor devices such as microphones, general electro-acoustic converters, communications components such as transceivers, control elements such as program switches, volume controls, actuators, electro-mechanical output converters such as speakers. Serving as an example only, the peripheral device $\mathbf{3}_E$ illustrated in FIG. 1 is a microphone, usually referred to as a receiver, the device $\mathbf{3}_A$ is a speaker. In the example shown, each of the two peripheral devices 3 is provided with an identification resistor, which for the device $\mathbf{3}_E$ is the identification resistor $R_1$, for the peripheral device $\mathbf{3}_A$ it is the identification resistor $R_2$. The value of either identification resistor R serves as a unique identifier for the associated peripheral device. An identification cycle is triggered as a function of the hardware configuration of the hearing aid. In that cycle, schematically represented by the cycling unit 7, all identification resistors R are connected on-line, for instance sequentially, to an impedance measuring unit 8 where the identification resistance R of the peripheral device concerned is measured. As those skilled in the art are fully aware, the preferred method is a DC resistance measurement by feeding a defined current to the identification resistors and measuring the resulting voltages on the resistors or, conversely, by predefining a particular voltage and measuring the resulting current. An AC-based impedance measurement is equally possible, although, depending on the frequency selected, the result of the measurement may be corrupted by parasitic reactances.

If the measurement shows an infinite resistance value $R\infty$, it indicates that an available port on the signal processing unit 1 does not have a peripheral device connected to it. The measurement results appearing for instance sequentially on the output side of the impedance measuring unit 8 as a function of the values $R_1$, $R_2$ etc., are fed to a comparator 9. Connected to a second port of the comparator 9 is an identification options memory module 11. The identification options memory module 11 stores all identification resistance values $R_1$, $R_2$ etc. individually mapped to peripheral devices that can be connected on-line to the signal processing unit 1. It is also entirely possible to provide the signal processing unit 1 with an identification marker, for instance an identification resistor according to the invention, which (not illustrated) is first measured via the cycling unit 7 and the impedance measuring unit 8 and is then compared with a resistance value (not illustrated) identifying the identification options memory module 11. If these resistance values match, it means that the identification options memory module 11 provided is compatible with the installed signal processing unit 1. If it does not, i.e. if the identification resistance value on the signal processing unit 1 does not agree with the resistance value identifying the identification options memory module 11, all further operations will be aborted and for instance an acoustic or visual alarm will be triggered on the hearing aid or on a port for an external station.

As schematically indicated by the cycling unit 13, this is followed by the sequential determination in the comparator 9, on the basis of the measured resistance values $R_1$, $R_2$ . . . , as to which of the peripheral devices defined in the identification options memory module 11 are present in the system configuration in question. For example, if a type X signal processing unit 1 and type M, N and W peripheral devices are connected on-line, the system configuration XNW will be stored in a hearing aid configuration memory 15 on the output side of the comparator. A comparison of the measured resistance values with those saved in the memory module 11 and the resistance-value/peripheral-device correlation assigned therein will unambiguously identify the peripheral device concerned.

On its output side the configuration memory 15 enables the signal processing unit. Based on the identified hardware configuration at hand, the switching circuit 17 will activate one or several specific processing modes in the signal processing unit 1. In other words, depending on the system configuration ascertained by means of the identification resistors, operating conditions corresponding to that configuration will be selected and activated in the signal processing unit 1, for instance specific programs in the digital signal processing unit 1*a*, and/or other settings such as amplifier adjustments in the analog amplifiers 1*b*.

In addition, the output of the configuration memory module 15 preferably connects to an output, HGA/HAO, of the hearing aid, which will identify the hearing aid in its individualized configuration for instance on a hearing aid adapter.

Figure 2:
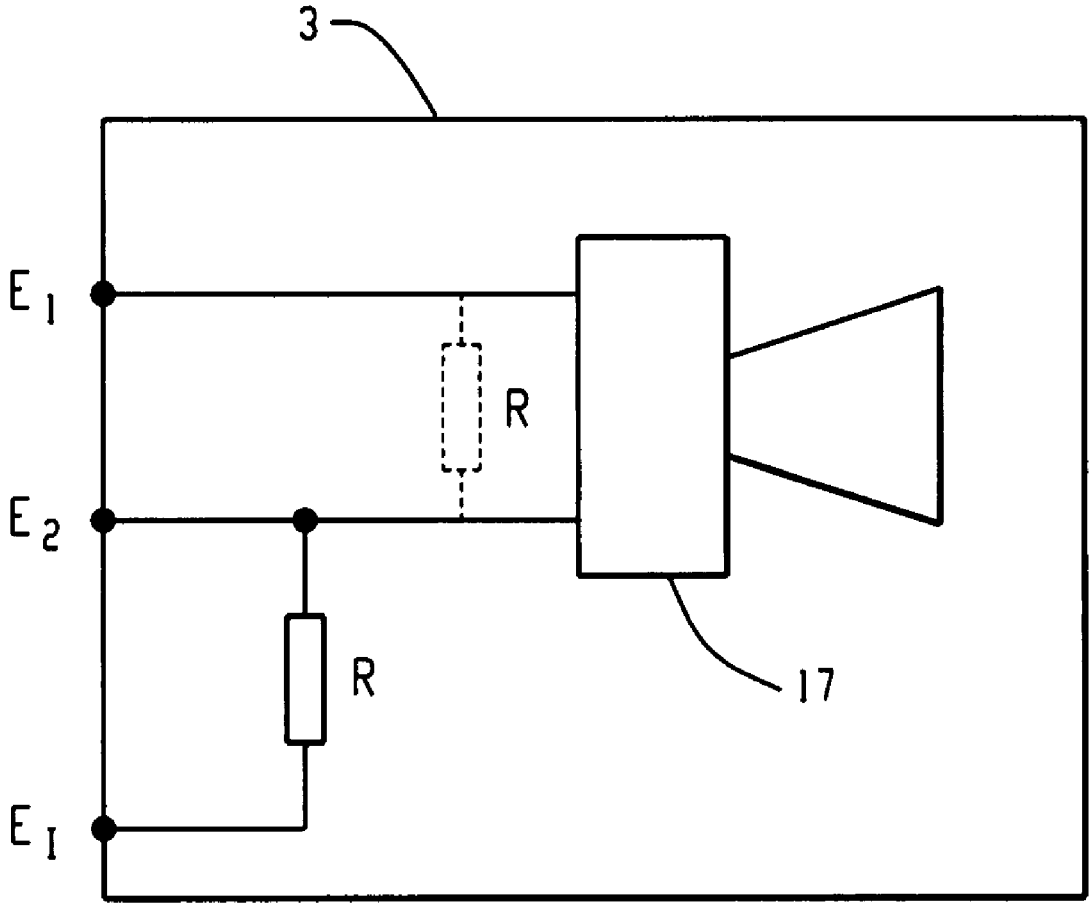
FIG. 2 is a schematic illustration of a speaker module as one example of a peripheral device according to the invention.

FIG. 2 shows in simplified schematic fashion a module, i.e. a peripheral device according to the invention, corresponding for instance to the devices $\mathbf{3}_E$ and $\mathbf{3}_A$ of FIG. 1. In all cases, any such preferred peripheral device, individually referred to as a module, will have inputs and outputs corresponding to its particular function, which in the example of a speaker module illustrated in FIG. 2 would be the inputs $E_1$ and $E_2$, to which the electric drive signal for the speaker 17 is applied. A module 3 according to the invention is provided with an identification resistor R which, via appropriate connections, can be measured in a manner whereby any self-impedance of the module, indicated by dashed $\overline{Z}$s, will have either a negligible or no influence on the determination of the value of R.

As shown in FIG. 2, the identification resistor R is preferably connected with one of its contacts to one of the module ports, $E_2$, as well as to a third port, $E_1$ per FIG. 2. Consequently, a module according to the invention is provided with the necessary ports for the signal inputs and/or outputs as well as an additional port, with the identification resistor R interpositioned between that additional port and one of the contacts on the module.

The hearing aid and the method according to the invention provide in an exceedingly simple manner a true, modular plug-and-play hearing aid system, permitting a dramatic reduction of the cost of manufacture, a minimized circuitry configuration in a signal processing unit of the hearing aid and maximal elimination of incorrect packaging, incorrect configurations, incorrect fitting etc. due to human negligence, the identification technique being extremely simple, reliable and easy to manipulate in terms of a quick acquisition of the identifiers. For the identification of units equipped with the identification resistor and for measuring the corresponding resistance value, only few additional provisions are needed on already existing systems, which in the case of peripheral devices include the installation of an additional resistor and on the receiver side a brief voltage or current injection on one of the connectors with a correspondingly brief current or voltage measurement.

The invention claimed is:

1. A hearing aid with a signal processing unit, an input and/or output side of which is functionally connected to a digital, hybrid or analog peripheral device, said peripheral device encompassing an identifying unit whose output effectively connects to a comparator, with the input side of the comparator on its part functionally connected to an identification options memory module, characterized in that the identifying unit is in the form of an identification resistor whose contacts connect to the comparator via a resistance measuring unit, wherein the comparator identifies said peripheral device from a single resistance value measured by said resistance measuring unit, wherein the peripheral device is an electromechanical output converter in the form of a speaker, and the speaker is provided with at least three ports comprising two speaker ports and one additional port, with the identification resistor connected to one of the speaker ports and to said the additional port.

2. Hearing aid as in claim 1, characterized in that said contacts serve exclusively for the measuring of the identification resistance.

3. Hearing aid as in claim 1, characterized in that the output of the comparator is functionally connected to an operating control input on the signal processing unit.

4. Hearing aid as in one of the claims 1 to 3, characterized in that the output of the comparator is functionally connected to the input of a configuration memory module.

5. Hearing aid as in claim 4, characterized in that the hearing aid is provided with an output that connects to the output of the configuration memory module.

6. A method for producing a hearing aid including a signal processing unit and, connected to the signal processing unit, at least one peripheral device, whereby the peripheral device is installed with the signal processing unit and the identity of the peripheral device is automatically queried and stored in memory, characterized in that the identity of the peripheral device is determined by means of a resistance measurement and from a single resistance value measured by said resistance measurement, wherein the peripheral device is an electromechanical output converter in the form of a speaker, and the speaker is provided with at least three ports comprising two speaker ports and one additional port, with the identification resistor connected to one of the speaker ports and to said the additional port.

7. Method as in claim 6, characterized in that the identity of the peripheral device so determined selects the operating mode of the signal processing unit and locks out any operation extrinsic to at least one of the object peripheral device and the signal processing unit.

8. Method as in claim 6 or 7, characterized in that, as a function of the identification, signals traveling to or from the connections of the signal processing unit are subjected to at least one of different interpretation and different processing.

9. A module for connection to a signal processing unit of a hearing aid, the module being equipped with at least three ports, characterized in that two of its ports are connected by an identification resistor that establishes a single resistance value uniquely identifying the module by the single resistance value, wherein the module is an electromechanical output converter in the form of a speaker, and the speaker is provided with said at least three ports comprising two speaker ports and one additional port, with the identification resistor connected to one of the speaker ports and to said additional port.

* * * * *